US010839982B2

(12) United States Patent
Kobayashi

(10) Patent No.: US 10,839,982 B2
(45) Date of Patent: Nov. 17, 2020

(54) TWINAXIAL PARALLEL CABLE

(71) Applicant: SUMITOMO ELECTRIC INDUSTRIES, LTD., Osaka (JP)

(72) Inventor: Yuto Kobayashi, Tochigi (JP)

(73) Assignee: SUMITOMO ELECTRIC INDUSTRIES, LTD., Osaka (JP)

( * ) Notice: Subject to any disclaimer, the term of this patent is extended or adjusted under 35 U.S.C. 154(b) by 0 days.

(21) Appl. No.: 16/956,783

(22) PCT Filed: Dec. 21, 2018

(86) PCT No.: PCT/JP2018/047227
§ 371 (c)(1),
(2) Date: Jun. 22, 2020

(87) PCT Pub. No.: WO2019/131500
PCT Pub. Date: Jul. 4, 2019

(65) Prior Publication Data

US 2020/0321142 A1 Oct. 8, 2020

(30) Foreign Application Priority Data

Dec. 27, 2017 (JP) ..... 2017-251729

(51) Int. Cl.
*H01B 7/08* (2006.01)
*H01B 7/22* (2006.01)

(52) U.S. Cl.
CPC ..... *H01B 7/0807* (2013.01); *H01B 7/226* (2013.01)

(58) Field of Classification Search
CPC ..... H01B 7/0807; H01B 7/226; H01B 7/184; H01B 7/185
USPC ..... 174/117 F
See application file for complete search history.

(56) References Cited

U.S. PATENT DOCUMENTS 5,144,098 A 9/1992 VanDeusen
5,208,426 A * 5/1993 Kennedy ..... H01B 11/1066 174/102 SC
2011/0100682 A1 5/2011 Nonen et al.
(Continued)

FOREIGN PATENT DOCUMENTS

JP S57-004116 U 1/1982
JP S59-017517 U 2/1984
JP H05-503807 6/1993
(Continued)

*Primary Examiner* — Sherman Ng
(74) *Attorney, Agent, or Firm* — IPUSA, PLLC

(57) ABSTRACT

A twinaxial parallel cable includes two conductors arranged parallel to each other, an insulating layer formed around the two conductors by extrusion coating, a shield tape wound around the insulating layer while extending longitudinally, a drain wire arranged inside the shield tape, and an outer coating formed to cover the shield tape. A cross section of the insulating layer perpendicular to a longitudinal direction of the twinaxial parallel cable is formed into an oval shape having a long axis that is 1.7 to 2.2 times a length of a short axis. The insulating layer has a groove in a portion including an intersection of an outline of the insulating layer and a perpendicular bisector of the long axis. The groove is formed to be more than 0.5 times to 0.9 times an outer diameter or a thickness of the drain wire. The drain wire is retained in the groove so that a part of the drain wire protrudes toward the shield tape beyond the insulating layer.

3 Claims, 2 Drawing Sheets

(56) References Cited

U.S. PATENT DOCUMENTS

| | | | | |
|---|---|---|---|---|
| 2014/0090869 | A1 | 4/2014 | Kaga et al. | |
| 2016/0372235 | A1* | 12/2016 | Sugiyama | H01B 11/002 |

FOREIGN PATENT DOCUMENTS

| | | |
|---|---|---|
| JP | 2002-304917 | 10/2002 |
| JP | 2011-096574 | 5/2011 |
| JP | 2014-089950 | 5/2014 |
| JP | 2017-004905 | 1/2017 |

* cited by examiner

TWINAXIAL PARALLEL CABLE

TECHNICAL FIELD

The present disclosure relates to a twinaxial parallel cable.

The present application is based on and claims priority to Japanese Patent Application No. 2017-251729, filed on Dec. 27, 2017, the entire contents of which are herein incorporated by reference.

BACKGROUND ART

Patent Document 1 discloses a cable comprising two conductors, an insulator formed to cover the two conductors, a drain wire, a shielding layer formed to cover the insulator and the drain wire, and a protective sheath formed to cover the shielding layer (see Patent Document 1).

PRIOR ART DOCUMENTS

Patent Documents

Patent Document 1: Japanese Laid-Open Utility Model Patent Application Publication No. 57-4116

SUMMARY OF THE INVENTION

A twinaxial parallel cable according to an embodiment of the present disclosure includes:

two conductors arranged parallel to each other;

an insulating layer formed around the two conductors by extrusion coating;

a shield tape wound around the insulating layer while extending longitudinally;

a drain wire arranged inside the shield tape; and an outer coating formed to cover the shield tape, wherein a cross section of the insulating layer perpendicular to a longitudinal direction of the twinaxial parallel cable is formed into an oval shape having a long axis that is 1.7 to 2.2 times a length of a short axis, and the insulating layer has a groove in a portion including an intersection of an outline of the insulating layer and a perpendicular bisector of the long axis, wherein the groove is formed to have a depth more than 0.5 times to 0.9 times an outer diameter or a thickness of the drain wire, and wherein the drain wire is retained in the groove so that a part of the drain wire protrudes toward the shield tape beyond the insulating layer.

MODE OF CARRYING GOUT THE INVENTION

Problems to be Solved by the Disclosure

There was room for improvement in twinaxial parallel cables in order to improve electrical characteristics of the cables.

The present disclosure is intended to provide a twinaxial parallel cable that can improve electrical characteristics.

Effect of the Disclosure

According to the present disclosure, a twinaxial parallel cable can be provided that can improve electrical characteristics.

Description of Embodiments of the Present Disclosure

Overview of Embodiments of the Present Disclosure

First, embodiments of the present disclosure are listed and described below.

A twinaxial parallel cable according to an embodiment of the present disclosure includes:

two conductors arranged parallel to each other;

an insulating layer formed around the two conductors by extrusion coating;

a shield tape wound around the insulating layer while extending longitudinally;

a drain wire arranged inside the shield tape; and an outer coating formed to cover the shield tape, wherein a cross section of the insulating layer perpendicular to a longitudinal direction of the twinaxial parallel cable is formed into an oval shape having a long axis that is 1.7 to 2.2 times a length of a short axis, and the insulating layer has a groove in a portion including an intersection of an outline of the insulating layer and a perpendicular bisector of the long axis, wherein the groove is formed to have a depth more than 0.5 times to 0.9 times an outer diameter or a thickness of the drain wire, and wherein the drain wire is retained in the groove so that a part of the drain wire protrudes toward the shield tape beyond the insulating layer.

Details of Embodiments of the Present Disclosure

A specific example of a twinaxial parallel cable according to an embodiment of the present disclosure will be described below with reference to the drawings.

It should be understood that the disclosure is not limited to these examples, but is intended to include all modifications within the meaning and scope of the claims and equivalents thereof.

First Embodiment

Figure 1:
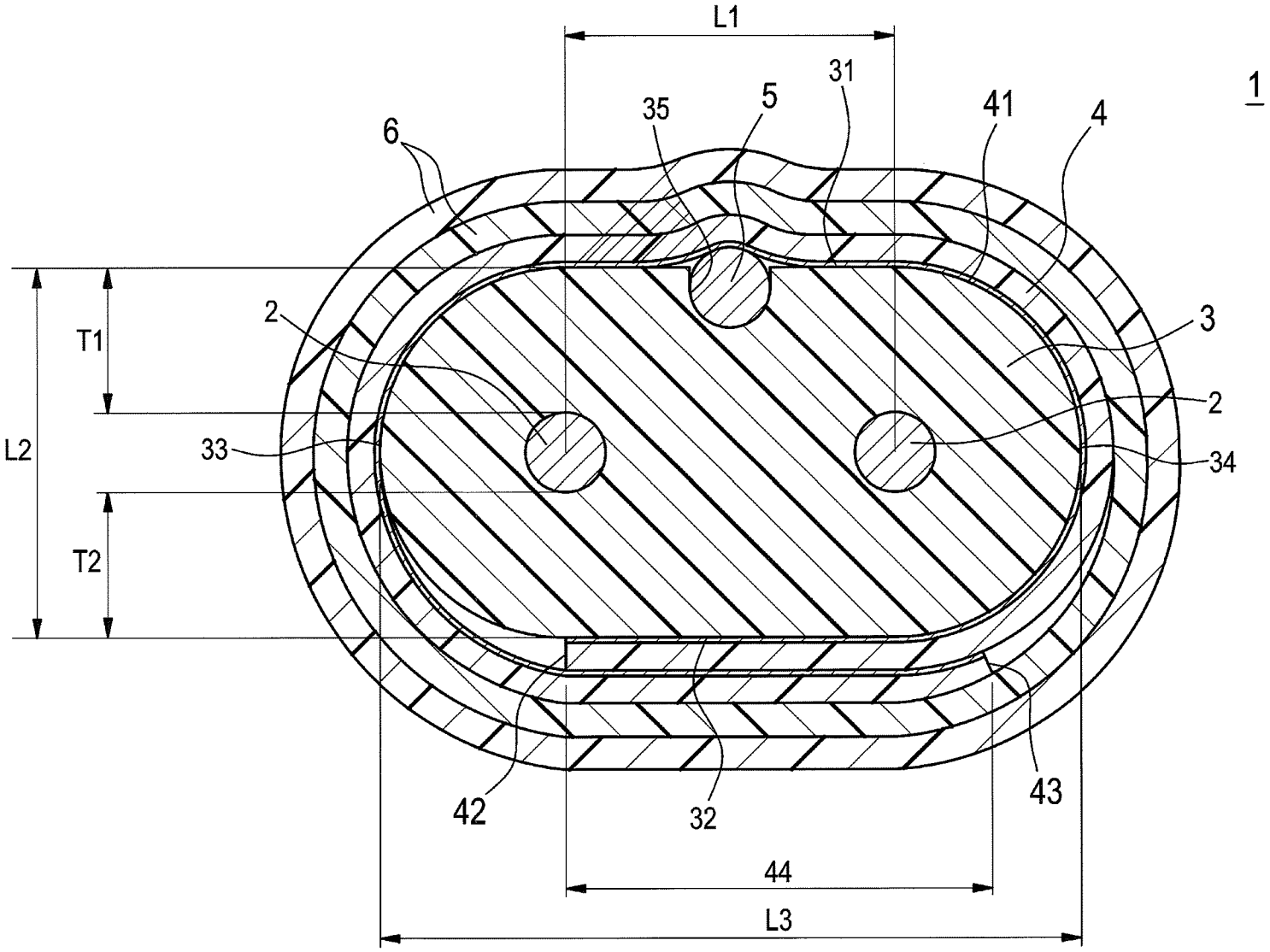
FIG. 1 a cross-sectional view showing a configuration of a twinaxial parallel cable according to one embodiment of the present disclosure.

FIG. 1 is a cross-sectional view illustrating a configuration of a twinaxial parallel cable 1 according to an embodiment of the present disclosure. For example, the twinaxial parallel cable 1 may be used as a cable utilized for a communication device that transmits and receives digital data at high speed.

As shown in FIG. 1, the twinaxial parallel cable 1 includes two conductors 2 and an insulating layer 3 formed around the two conductors 2. The twinaxial parallel cable 1 includes a shield tape 4 wound around the periphery of the insulating layer 3, a drain wire 5 disposed inside the shield tape 4, and an outer coating 6 formed to cover the shield tape 4.

The two conductors 2 have substantially the same structure and are arranged in parallel with each other. L1 shown in FIG. 1 is a distance between the centers of the two conductors 2.

The conductor 2 is a single wire or a twisted wire formed of a conductor such as copper, aluminum, or an alloy containing them primarily, a conductor plated with tin, silver, or the like. The dimension of a conductor used as the conductor 2 is, for example, AG26 to AWG36 in AWG (American Wire Gauge) standard. The cross-sectional area of the conductor 2 is 0.01 $mm^2$ to 0.16 $mm^2$.

The insulating layer 3 is made of a thermoplastic resin having a low dielectric constant, such as polyolefin. The insulating layer 3 is formed, for example, by being supplied from an extruder, extruded and molded, to the conductors 2 while coating the conductors 2 together. The insulating layer 3 is formed into an oval shape in a cross section perpendicular to a lengthwise direction of the twinaxial parallel cable 1.

As used herein, a "cross section" means a cross section viewed from a longitudinal direction of the twinaxial parallel cable. An "oval shape" means shapes including an ellipse shape, an oval shape obtained by extending a circular shape, a shape in which two parallel lines are connected by an arc-shaped curve, and the like.

When a direction in which the two conductors 2 are aligned in the cross section of the insulating layer 3 is defined as a horizontal direction, and a direction perpendicular to the horizontal direction is defined as a vertical direction, the insulating layer 3 has flat portions 31 and 32 that horizontally extend above and below the two conductors 2. The insulating layer 3 has semicircular portions 33 and 34 on the right and left sides of the two conductors.

The cross section of the insulating layer 3 is formed into an oval shape in which the length of the long axis L3 is 1.7 to 2.2 times the length of the short axis L2 (the short axis and the long axis are indicated by the symbol in the drawing). More preferably, the cross section of the insulating layer 3 is formed into an oval shape such that the length of the long axis L3 is twice the length of the short axis L2. In this example, the oval shape of the cross section of the insulating layer 3 has, for example, about 3.14 mm long axis*about 1.57 mm short axis in the design of AWG 26, about 2.24 mm long axis*about 1.12 mm short axis in the design of AWG 28, about 1.80 mm long axis*about 0.90 mm short axis in the design of AWG 30, and about 0.78 mm long axis*about 0.39 mm short axis in the design of AWG 36.

Here, a thickness deviation ratio of the insulating layer 3 in the thickness direction (the vertical direction in FIG. 1) will be described. The thickness deviation ratio in the thickness direction is a ratio of the minimum value to the maximum value of the thickness with respect to the thicknesses T1 and T2 of the insulating layer 3 at the top and bottom of the conductor 2, respectively. The thickness deviation ratio of the insulating layer 3, which is a ratio of minimum/maximum value of the thicknesses, is preferably close to 1.0 in the lengthwise direction of the twinaxial parallel cable 1. When the deviation ratio of the insulating layer 3 in the thickness direction is 1.0, the thickness T1 and the thickness T2 of the insulating layer 3 are the same. When the thickness T1 and the thickness T2 of the insulating layer 3 are the same, the twinaxial parallel cable 1 has preferable electrical characteristics. The thickness deviation ratio can be brought close to 1.0 by adjusting the extrusion conditions of the insulating resin. The deviation ratio can be adjusted, for example, by adjusting the resin pressure during extrusion of the insulating resin, the speed of the screw, the linear speed of the conductors 2, the shape of the resin passage, and the like.

The electrical characteristics of the twinaxial parallel cable 1 become worse when the deviation ratio in the thickness direction of the insulating layer 3 is low. The allowable thickness deviation ratio of the insulating layer 3 in terms of preferable electrical characteristics is 0.85 or greater. The thickness of the insulating layer 3 may vary along the length of the twinaxial parallel cable 1. In order to stabilize the electrical characteristics of the twinaxial parallel cable 1, a variation of the thickness of the insulating layer 3 in the longitudinal direction is preferably small. The preferable thickness deviation ratio, when the variation in the thickness of the insulating layer 3 is considered, is 0.85 or more and 1.0 or less in a range of 5 m of the length of the twinaxial parallel cable 1. In the present example, the insulating layer 3 is formed so that the minimum value/maximum value of the thickness of the insulating layer 3 positioned above and below at least one of the two conductors 2 is 0.85 or more and 1.0 or less in a range of 5 m of the length of the twinaxial parallel cable 1.

The insulating layer 3 has a groove 35 at a portion that includes an intersection of an outline in an oval shape and a perpendicular bisector of the longitudinal axis L3. While grooves 35 may be formed in both of the flat portions 31 and 32, it is preferable to form grooves 35 in either of the flat portions 31 and 32 in order to improve electrical characteristics. In the present example, the groove 35 is formed on the flat portion 31 as shown in FIG. 1.

The grooves 35 are formed into a shape that fits the outline of the drain wire 5. If the cross-sectional shape of the drain wire 5 is circular, the groove 35 is formed into an arc shape at the bottom portion thereof along the drain wire 5. If the cross section of the drain wire 5 is other than circular, for example, rectangular, the bottom portion of the groove 35 is formed into a rectangle.

Also, the groove 35 is formed to have a depth more than 0.5 times to 0.9 times the outer diameter or thickness of the drain wire 5. If the depth of the groove 35 is less than 0.5 times the outer diameter or thickness of the drain wire 5, the drain wire 5 may deviate from the groove 35 and meander. If the depth of the groove 35 is greater than 0.9 times the outside diameter or thickness of the drain wire 5, the drain wire 5 may enter the groove 35 too deeply and unstably contact the shield tape 4, which is liable to make electrical characteristics of the twinaxial parallel cable 1 unstable.

More preferably, the depth of the groove 35 is 0.6 to 0.8 times the outer diameter of the drain wire 5. More preferably, the depth of the groove 35 is 0.7 times the drain wire 5. In the present example, the groove 35 is formed so that the bottom of the groove 35 becomes an arc shape along the drain wire 5 having a circular shape in the cross section, and the deepest point is about 0.18 mm (0.72 times the outer diameter of the drain wire). By forming the groove 35 at such a depth, the drain wire 5 is held in the groove 35 so as to protrude toward the shield tape 4 beyond the insulating layer 3, and securely contacts the shield tape 4.

The shield tape 4 is formed of a metal layer resin tape on which a metal layer 41, such as aluminum, is attached or deposited on a resin tape such as polyester. The shield tape 4 is wound longitudinally around the insulating layer 3 and outside the drain wire 5. The shield tape 4 has an overlapping portion 44 that overlaps a region from a winding start position 42 to a winding end position 43 of the shield tape 4. The overlapping portion 44 is disposed in either of the flat portion 31 or 32 of the insulating layer 3. In the present example, as shown in FIG. 1, the overlapping portion 44 is disposed in the flat portion 32.

The overlapping portion 44 is formed so that the length in the horizontal direction (the horizontal direction in FIG. 1) is 0.7 times to 1.3 times the distance L1 between the centers of the two conductors 2. In this way, the electrical characteristics of the twinaxial parallel cable 1 are likely to be stabilized.

The shield tape 4 is wound such that the metal layer 41 faces the insulating layer 3 and the drain wire 5. In the present example, the shield tape 4 is wound while longitudinally extending along and over the insulating layer 3 and the drain wire 5. The shield tape is wound so that the winding start position and the winding end position of the shield tape become parallel to the longitudinal direction of the twinaxial parallel cable.

The shield tape 4 may have an adhesive on the overlapping portion 44, and the shield tape 4 in the overlapping portion 44 may be adhered to each other with the adhesive to maintain the shape in which the shielding tape 4 is wound.

The drain wire 5 is a conductor wire such as copper or aluminum. The drain wire 5 is positioned inside the shield tape 4 and is positioned longitudinally in a direction parallel to the longitudinal direction of the twinaxial parallel cable 1 (the perpendicular direction to the paper plane of FIG. 1), and is retained in the groove 35 of the insulating layer 3. The cross-sectional shape of the drain wire 5 may be circular or rectangular.

In the present example, the drain wire 5 is an annealed tin-plated copper wire and has a circular cross section. The diameter of the drain wire 5 is, for example, 0.18 to 0.3 mm. In the present example, in the design of AWG 26, the depth of the groove 35 is about 0.18 mm and the diameter of the drain wire 5 is about 0.25 nm. Therefore, the drain wire 5 is held in the groove 35 such that a portion of the drain wire 5 (in the present example, the design of AWG 26 is about 0.07 nm) protrudes toward the shield tape 4 beyond the flat portion 31 of the insulating layer 3.

In this way, because the metal layer 41 of the shield tape 4 securely contacts the drain wire 5, the electrical characteristics of the twinaxial parallel cable 1 are readily stabilized. Also, the drain wire 5 is retained in the groove 35 to prevent the drain wire 5 from meandering on the insulating layer 3. This improves the electrical characteristics of the twinaxial parallel cable 1.

The outer coating 6 is formed of a resin tape, such as polyester. The outer coating 6 is wound, for example, in a spiral (horizontal winding) to cover the outer periphery of the shield tape 4. The resin forming the outer coating 6 may be crosslinked to enhance heat resistance. In the present example, the outer coating 6 is formed by winding the polyester tape horizontally double in the same direction. In addition, when the resin tape is double wound to form the outer coating 6, the winding direction may not be limited to the same direction, and may be the reverse direction.

In the meantime, twinaxial parallel cables used, for example, for high-speed communications, are required to have better electrical characteristics. For this reason, in conventional cable configurations in which the entire drain wire is embedded in the insulator, the drain wire completely penetrates the insulator while creating a gap between the drain wire and the shield tape, and the electrical characteristics may not be sufficient.

In contrast, in the twinaxial parallel cable 1 according to one embodiment of the present disclosure, the drain wire 5 is retained in the groove 35 so that a part of the drain wire 5 protrudes toward the shield tape 4 beyond the insulating layer 3 as described above. Therefore, a part of the drain wire 5 on the side of the shield tape 4 securely contacts the shield tape 4 that is wound around the insulating layer 3. That is, the drain wire 5 does not enter the groove 35 too much and does not cause the shield tape 4 to float, and the drain wire 5 does not deviate from the groove 35 and does not meander. Thus, the electrical identification of the twinaxial parallel cable 1 is stabilized, and so the electrical characteristics of the twinaxial parallel cable 1 can be improved.

Further, in the twinaxial parallel cable 1 according to one embodiment of the present disclosure, because the groove 35 is arranged at the flat portion 31 at which the overlapping portion 44 is not arranged, the winding start position 42 and the winding end position 43 of the longitudinally attached shield tape 4 are arranged at the flat portion 32. Due to this arrangement, because the shield tape 4 in the overlapping portion 44 is overlapped on the flat portion 32, the longitudinal adherence of the shield tape 4 is unlikely to open. This makes it easier to stabilize the electrical characteristics of the twinaxial parallel cable 1.

Although the groove 35 is formed only in the flat portion 31 in the present embodiment, the groove 35 may be formed at each of the flat portions 31 and 32, from the viewpoint of easily adjusting the characteristic impedance of the twinaxial parallel cable and from the viewpoint of easily manufacturing the insulating layer 3. When grooves 35 are each formed at the flat portions 31 and 32, the drain wire 5 is disposed in each of the grooves or one groove. If the drain wire is disposed in one of the grooves 35, the groove 35 without the drain wire 5 is covered with a shield tape 4 that is tightly stretched to prevent wrinkling. This arrangement prevents the shield tape 4 from entering the groove 35 and prevents the electrical characteristics from becoming worse.

Working examples of the present disclosure will be described below. Electrical characteristics (Scd21-Sdd21) of the twinaxial parallel wires of the following examples and comparative examples were tested. The Scd21-Sdd21 is a common mode output relative to a differential mode output.

(Working Example)

The configuration of the twinaxial parallel cable 1 of the working example was the same as the configuration of the first embodiment shown in FIG. 1, and was set as follows.

Two copper wires of AWG 26 (conductor 2, 0.41 mm in diameter) were arranged in parallel, and the periphery was integrally covered with polyolefin (insulating layer 3) through extrusion molding. The insulating layer 3 was formed as an oval-shaped cross section with a long axis L of 32.74 mm and a short axis L of 21.37 mm. In the upper flat portion 31 of the insulating layer 3, a groove 35 was formed in which the bottom was circular and the depth of the deepest portion was 0.18 mm.

The annealed tin-plated copper wire was formed to have a circular cross sec-ion to form a drain wire 5 having a diameter of 0.25 nm. A single drain wire 5 was disposed in the groove 35 of the insulating layer 3. The drain wire 5 was held in the groove 35 so that a part (0.07 mm) of the drain wire 5 protruded from the flat portion 31 of the insulating layer 3 toward the shield tape 4.

Aluminum was deposited on a polyester resin tape using a vacuum vapor deposition method to form an aluminum-deposited polyester resin tape (shield tape 4). The shield tape 4 was wound on the outer peripheral surface of the insulating layer 3 and the drain wire 5 while extending longitudinally so that the surface of the aluminum of the shield tape 4 is arranged inside. Two polyester tapes were spirally wound on the outside of the shield tape 4 to form the outer coating 6.

In the working example of the above-described configuration, a high frequency signal from 0 GHz to 19 GHz was transmitted through the twinaxial parallel cable 1, and the electrical characteristics (Scd21-Sdd21) were obtained.

Comparative Example

In a comparative example, a groove 35 was formed with a depth of 0.25 mm; a diameter of the drain wire 5 was formed at 0.25 mm; and the entire drain wire 5 was buried in the insulating layer 3. The other configurations were similar to those of the embodiment.

(Test Results)

Figure 2:
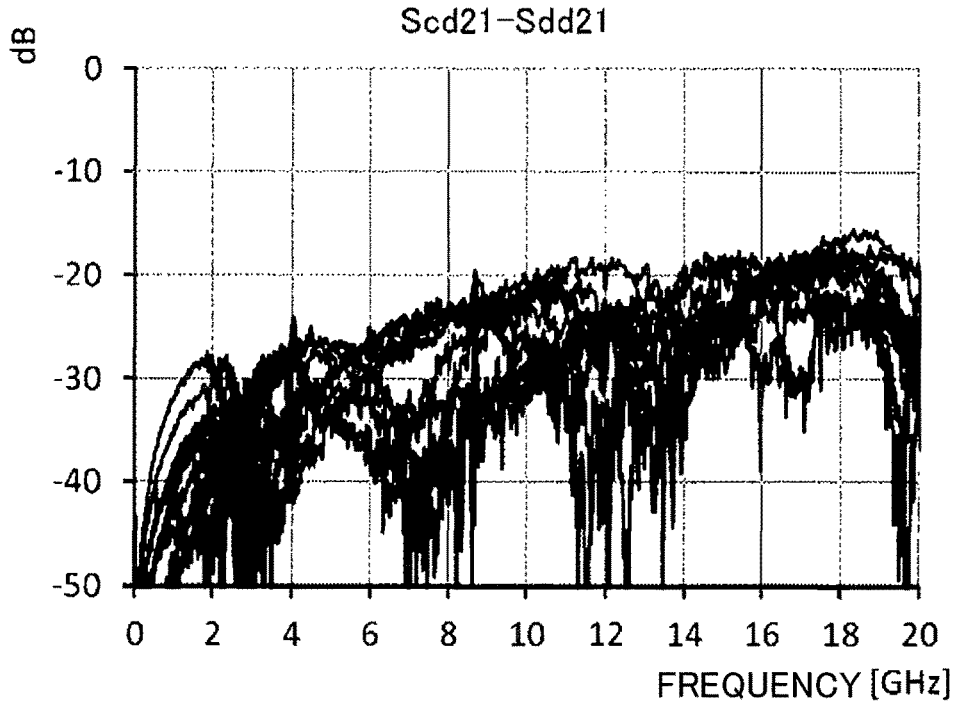
FIG. 2 is a diagram for explaining electrical characteristics (Scd21-Sdd21) of a working example.
Figure 3:
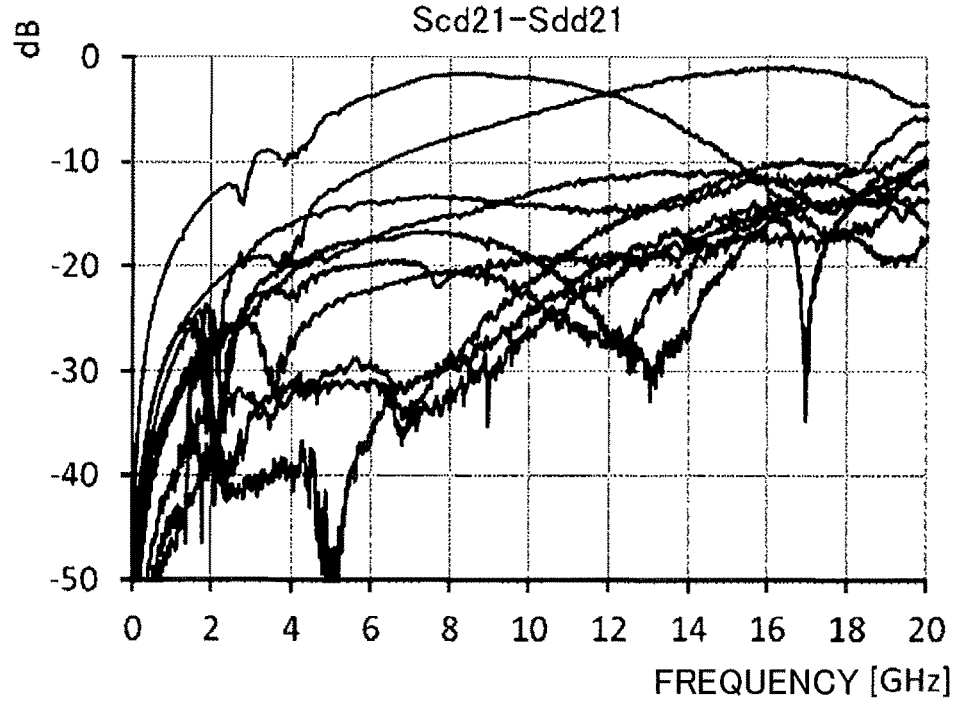
FIG. 3 is a diagram for explaining electrical characteristics (Scd21-Sdd21) of a comparative example.

With respect to each of the above working example and the comparative example, electrical characteristics results (Scd2l-Sdd21) of 10 samples were compared to each other (see FIGS. 2 and 3).

Comparing FIGS. 2 and 3, the electrical characteristics (Scd2l-Sdd21) have the maximum value of −1 dB as shown in FIG. 3 in the comparative example, but have the maximum value of −15 dB as shown in FIG. 2 in the working example, and the working example is preferable. Each of the working examples shown in FIG. 2 also has a preferable variation.

From the above-described results, it can be confirmed that the electrical characteristics (Scd21-Sdd2) of the twinaxial parallel cable 1 having the drain wire 5 held in the groove 35 so that a part of the drain wire 5 protrudes toward the shield tape 4 beyond the insulating layer 3, are better than those of the twinaxial parallel cable having the entire drain wire 5 embedded in the insulating layer 3.

Although the present disclosure has been described in detail and with reference to certain embodiments, it will be apparent to those skilled in the art that various changes and modifications may be made without departing from the spirit and scope of the present disclosure. Further, the number, position, shape and the like of the components described above are not limited to the above-described embodiments, and the number, position, shape and the like may be changed to those suitable for carrying out the present disclosure.

Preferred Embodiments of the Present Disclosure

Hereinafter, preferred embodiments of the present disclosure will be described.

[Appendix 1]

A twinaxial parallel cable according to an embodiment of the present disclosure includes:

two conductors arranged parallel to each other;

an insulating layer formed around the two conductors by extrusion coating;

a shield tape wound around the insulating layer while extending longitudinally;

a drain wire arranged inside the shield tape; and an outer coating formed to cover the shield tape, wherein a cross section of the insulating layer perpendicular to a longitudinal direction of the twinaxial parallel cable is formed into an oval shape having a long axis that is 1.7 to 2.2 times a length of a short axis, and the insulating layer has a groove in a portion including an intersection of an outline of the insulating layer and a perpendicular bisector of the long axis, wherein the groove is formed to have a depth more than 0.5 times to 0.9 times an outer diameter or a thickness of the drain wire, and wherein the drain wire is retained in the groove so that a part of the drain wire protrudes toward the shield tape beyond the insulating layer.

According to the twinaxial parallel cable of the above-described configuration, the groove is formed to be more than 0.5 times to 0.9 times the outer diameter or thickness of the drain wire, and the drain wire is held in the groove so that a part of the drain wire protrudes toward the shield tape beyond the insulating layer. Therefore, the drain wire securely contacts the shield tape and the drain wire is retained in the groove without meandering. This makes it easier to stabilize the electrical characteristics of the twinaxial parallel cable and can improve the electrical characteristics.

[Appendix 2]

In the twinaxial parallel cable as described in Appendix 1, wherein, when a direction in which the two conductors are aligned is defined as a horizontal direction and a direction perpendicular to the horizontal direction is defined as a vertical direction in the cross section, the insulating layer may include flat portions extending in the horizontal direction above and below the two conductors, and semicircular portions on the right and left sides of the two conductors, wherein the shield tape may include an overlapping portion between a winding start position of the shield tape and a winding end position of the shield tape, wherein the overlapping portion may be arranged at either of the flat portions, and wherein the groove may be formed at the other of the flat portions at which the overlapping portions is not arranged.

According to this arrangement, the overlapping portion of the shield tape is disposed on either of the flat portions, and the drain wire is disposed on a flat portion at which the overlapping portion is not arranged. As a result, it becomes difficult to open the longitudinally attached shield tape and the electrical characteristics of the twinaxial parallel cable is easily stabilized. This can improve the electrical characteristics of the twinaxial parallel cable.

[Appendix 3]

Moreover, in the above-described twinaxial parallel cable of Appendix 1, wherein a length of the overlapping portion in the horizontal direction may be formed to be 0.7 to 1.3 times a length of a distance between centers of the two conductors.

This configuration facilitates stabilization of the electrical characteristics of the twinaxial parallel cable. This can improve the electrical characteristics of the twinaxial parallel cable.

[Appendix 4]

In the above-described twinaxial parallel cable described in any one of Appendix 1 to Appendix 3, wherein the insulating layer may be formed to have a maximum value/minimum value of thicknesses of the insulating layer located at least above and below the two conductors in a range of 0.85 to 1.0 in the oval shape in a range within a length of 5 m.

According to this configuration, the electrical characteristics of the twinaxial parallel cable can be further improved because there is less misalignment in the thickness direction of each conductor.

DESCRIPTION OF THE REFERENCE NUMERALS

1 twinaxial parallel wire
2 conductor
3 insulation layer
4 shield tape
5 drain wire
6 outer coating

31, 32 flat portions
33, 34 semicircular portion
35 groove
41 metal layer
42 winding start position
43 winding finish position
44 overlapping portion
L1 (center-to-center) distance
L2 short axis
L3 long axis

The invention claimed is:

1. A twinaxial parallel cable, comprising: two conductors arranged parallel to each other; an insulating layer formed around the two conductors by extrusion coating; a shield tape wound around the insulating layer while extending longitudinally; a drain wire arranged inside the shield tape; and an outer coating formed to cover the shield tape, wherein a cross section of the insulating layer perpendicular to a longitudinal direction of the twinaxial parallel cable is formed into an oval shape having a long axis that is 1.7 to 2.2 times a length of a short axis, and the insulating layer has a groove in a portion including an intersection of an outline of the insulating layer and a perpendicular bisector of the long axis, wherein the groove is formed to have a depth more than 0.5 times to 0.9 times an outer diameter or a thickness of the drain wire, wherein the drain wire is retained in the groove so that a part of the drain wire protrudes toward the shield tape beyond the insulating layer, and wherein, when a direction in which the two conductors are aligned is defined as a horizontal direction and a direction perpendicular to the horizontal direction is defined as a vertical direction in the cross section, the insulating layer includes flat portions extending in the horizontal direction above and below the two conductors, and semicircular portions on the right and left sides of the two conductors, wherein the shield tape includes an overlapping portion between a winding start position of the shield tape and a winding end position of the shield tape, wherein the overlapping portion is arranged at either of the flat portions, and wherein, the groove is formed at the other of the flat portions at which the overlapping portions are not arranged.

2. The twinaxial parallel cable as claimed in claim 1, wherein a length of the overlapping portion in the horizontal direction is formed to be 0.7 to 1.3 times a length of a distance between centers of the two conductors.

3. The twinaxial parallel cable as claimed in claim 1, wherein the insulating layer is formed to have a maximum value/minimum value of thicknesses of the insulating layer located at least above and below the two conductors in a range of 0.85 to 1.0 in the oval shape in a range within a length of 5 m.

* * * * *